US009309090B2

(12) United States Patent
De Coi et al.

(10) Patent No.: US 9,309,090 B2
(45) Date of Patent: Apr. 12, 2016

(54) SAFETY APPARATUS FOR AN ELEVATOR APPARATUS AND A DRIVE APPARATUS THEREOF

(71) Applicant: Cedes AG, Landquart (CH)

(72) Inventors: Beat De Coi, Sargans (CH); Tobias Leutenegger, Chur (CH); Dumeng Hersche, Bonaduz (CH); Jurg Hegelbach, Oberriet (CH)

(73) Assignee: Cedes AG, Landquart (CH)

( * ) Notice: Subject to any disclaimer, the term of this patent is extended or adjusted under 35 U.S.C. 154(b) by 682 days.

(21) Appl. No.: 13/675,303

(22) Filed: Nov. 13, 2012

(65) Prior Publication Data

US 2013/0146399 A1 Jun. 13, 2013

Related U.S. Application Data

(60) Provisional application No. 61/569,429, filed on Dec. 12, 2011.

(30) Foreign Application Priority Data

Dec. 12, 2011 (EP) ..... 11 009 791

(51) Int. Cl.
*B66B 1/34* (2006.01)
*B66B 5/00* (2006.01)
*B66B 13/22* (2006.01)

(52) U.S. Cl.
CPC ..... *B66B 5/0031* (2013.01); *B66B 13/22* (2013.01)

(58) Field of Classification Search
CPC ..... B66B 5/0031; B66B 13/22; B66B 5/02
USPC ..... 187/247, 316, 317, 391–393; 49/26, 28, 49/118; 318/280–286, 466–470
See application file for complete search history.

(56) References Cited

U.S. PATENT DOCUMENTS

| | | | | |
|---|---|---|---|---|
| 4,750,591 | A * | 6/1988 | Coste et al. | 187/391 |
| 5,107,964 | A * | 4/1992 | Coste et al. | 187/280 |
| 6,173,814 | B1 * | 1/2001 | Herkel et al. | 187/288 |
| 6,193,019 | B1 * | 2/2001 | Sirigu et al. | 187/391 |
| 7,252,180 | B2 * | 8/2007 | Deplazes et al. | 187/393 |
| 7,334,665 | B2 * | 2/2008 | Smith et al. | 187/247 |
| 7,708,118 | B2 * | 5/2010 | Tyni et al. | 187/391 |
| 8,230,977 | B2 * | 7/2012 | Thumm et al. | 187/247 |

(Continued)

FOREIGN PATENT DOCUMENTS

| | | |
|---|---|---|
| EP | 0 905 901 A1 | 3/1999 |
| GB | 876 371 A | 8/1961 |

OTHER PUBLICATIONS

European Search Report dated Jun. 8, 2012.

*Primary Examiner* — Anthony Salata
(74) *Attorney, Agent, or Firm* — Burr & Brown, PLLC

(57) ABSTRACT

A safety apparatus for elevator apparatuses which can move a cab via a drive including a monitoring unit for monitoring at least one of the drive and/or the motor regulation system of the drive, a safety device having at least two sensors, which can be switched between at least two switching states depending on a state, in particular a closing state. In order to be able to reduce operating costs, at least one of the safety device and the monitoring unit includes a controller, which is designed to identify the respective switching states of the sensors, and to transmit at least one of data and monitoring signals to the monitoring unit.

11 Claims, 3 Drawing Sheets

(56) References Cited

U.S. PATENT DOCUMENTS

| | | | | |
|---|---|---|---|---|
| 8,413,765 | B2 * | 4/2013 | Stratmann | 187/247 |
| 8,672,099 | B2 * | 3/2014 | De Coi et al. | 187/316 |
| 8,820,482 | B2 * | 9/2014 | De Coi et al. | 187/247 |
| 9,004,230 | B2 * | 4/2015 | De Coi et al. | 187/391 |
| 2010/0051391 | A1 | 3/2010 | Jahkonen | |
| 2011/0036668 | A1 | 2/2011 | Stratmann | |

* cited by examiner

SAFETY APPARATUS FOR AN ELEVATOR APPARATUS AND A DRIVE APPARATUS THEREOF

CROSS REFERENCE TO RELATED APPLICATIONS

This application claims the benefit under 35 USC §119(e) of U.S. Provisional Application 61/569,429, filed Dec. 12, 2011, and claims the benefit under 35 USC §119(a)-(d) of European Application No. 11 009 791.2 filed Dec. 12, 2011, the entireties of which are incorporated herein by reference.

FIELD OF THE INVENTION

The invention relates to a safety apparatus for elevator apparatuses, a drive apparatus for an elevator apparatus and an elevator apparatus.

BACKGROUND OF THE INVENTION

The prior art discloses conventional safety apparatuses for elevators which use electrical or electromechanical contacts and switches in order to determine the locking or closing state of an elevator door. Travel of an elevator cab should in this case only be permitted when all of the doors are locked. If, for example, an elevator door is blocked and cannot be closed, the cab should also not be able to continue its journey. In order to achieve this, in the case of conventional elevator apparatuses, the corresponding electromechanical switch at the door opens a contactor, which is connected into the working circuit and therefore directly interrupts the drive by virtue of the power supply to the drive motor or the drive circuit being interrupted by the contactor, for example.

SUMMARY OF THE INVENTION

The object of the invention is to propose a safety apparatus, a drive apparatus and an elevator apparatus in which the operational costs can be reduced and which at the same time enable improved maintenance.

Correspondingly, a safety apparatus according to the invention for elevator apparatuses which can move a cab via a drive is characterized by the fact that the safety device comprises a controller which is designed to identify the respective switching states of the sensors and to transmit data and/or monitoring signals to the monitoring unit. The safety apparatus in this case comprises a monitoring unit for monitoring the drive and/or the motor regulation system of the drive. Such a monitoring unit can be, for example, a lift control system. Within the meaning of the invention, monitoring means control and/or regulation. Such a lift control system receives, for example, commands from the corresponding operator who is waiting in front of the elevator, for example, and actuates a pushbutton in order to call the elevator. In addition, the lift control system receives commands which are output by people located in the cab who are selecting a corresponding story to which they wish to travel by means of depressing a pushbutton. The lift control system or the monitoring unit can also control the motor regulation system of the drive motor during regular operation, however (for example smooth approach, braking, standby operation, etc.).

In addition, the safety apparatus comprises a safety device with at least two sensors, which can be switched between at least two switching states depending on a state to be detected by the sensors, in particular a closing state. The closing state may be, for example, the closing state of the elevator door. However, it is also conceivable, for example, for a temperature sensor to be provided which, above a determined limit temperature, for example that of the motor, interrupts the journey. A particularly relevant application is, however, the detection of the locking or the closing state of the elevator door.

In contrast to electromechanical switches which are opened and closed and therefore mean the interruption of a circuit, sensors have the advantage that the sensors regularly only detect a determined physical variable and as a result do not need to interrupt a circuit. Electromechanical switches or contacts also have the disadvantage that, during opening and closing of the circuit, a flashover may occur even at low voltages, and this flashover may result in slight burns at the contacts. Corrosion at the contacts may be the consequence and this may result in non-conducting points. In the safety apparatus according to the invention, the corresponding sensors are connected to a controller, which is part of the safety device. Thus, the controller can identify the corresponding switching states of the sensors, i.e., for example, whether a door is closed and the lock has engaged or not. In addition, the controller is capable of transmitting data and/or monitoring signals to the monitoring unit of the safety apparatus. Such data or monitoring signals can be measured values of any desired type, digital or analog signals, commands, etc. The transmission of identification codes, for example for identifying the sensors or the controller, is also conceivable. The transmission can take place in the form of special protocols, if appropriate.

A particular advantage of such an apparatus is the fact that the safety device can also be supervised via the monitoring unit and the corresponding signals or data which give information on the status of the sensors and therefore on the functionality of the elevator can be transmitted directly to the monitoring unit or can be supervised directly via the monitoring unit. This measure provides new possibilities in respect of the maintenance possibilities. In addition, the susceptibility to maintenance can be reduced by supervision of the monitoring unit.

In conventional safety circuits, the safety circuits nevertheless have to be monitored regularly. Since the safety circuit has been completely isolated from the remaining units of the elevator to a certain extent in order to be independently functional, it would be necessary for all of the component parts of this safety circuit including all of the electromechanical sensors to be monitored individually when faults occur and maintenance is due. Since such a safety circuit naturally extends over the entire length of the elevator, such maintenance is particularly complex. Owing to the use of sensors, the states and functionality of said sensors can nevertheless be supervised directly. This constant supervision can take place particularly advantageously directly via the monitoring unit or lift control system in the invention. Furthermore, the possibility is also provided of the disconnection taking place directly via the lift control system. As a result, a particularly compact design is in particular also made possible.

However, it is not absolutely essential that the data transmission takes place in only one direction from the controller to the monitoring unit or the lift control system. Instead, data interchange is also possible in an advantageous embodiment of the invention. In this case, the controller is designed to receive data and/or monitoring signals from the monitoring unit. The lift control system can then also transmit commands or data to the controller. For example, the monitoring unit can check the status of the sensors and therefore also once again check the functionality, if required.

In order to be able to once again increase safety, the monitoring unit comprises an interruption apparatus for interrupting the drive depending on data and/or monitoring signals from the controller. Such an interruption apparatus can be in the form of a relay or a contactor, for example. This relay or contactor can be connected directly into the drive circuit, for example, via which the motor is supplied with current. In principle, it is also conceivable for the monitoring unit to address the motor regulation system directly and to disconnect the motor regulation system, with the result that the journey of the elevator is likewise interrupted without delay. In addition, it is conceivable for the motor regulation system to provide a special command which directly interrupts the journey of the elevator and, with this command, the monitoring unit addresses the motor regulation system in such a case. Such an interruption can take place, for example, when one of the doors has not been correctly locked or is blocked and the journey cannot be resumed.

In a particularly advantageous manner, the sensors can be connected in series. Such a circuit therefore corresponds to an AND circuit, i.e. an interruption interrupts the entire circuit. As a result of this measure, safety can be increased, if appropriate.

Furthermore, the safety device can be in the form of a bus system, wherein the sensors each have an electronics unit, which is connected to the bus, with the result that the switching states of the sensors and/or the identification data of the sensors can be called up and/or transmitted via the bus. Such a bus enables in particular the transmission and/or the interchange of data. For example, data of individual sensors can be read directly on command. In principle, a bidirectionally operating bus in which data can be transmitted and received is conceivable. In principle, however, a unidirectional bus is also conceivable. As data, it is possible to transmit the switching states, but also identification data of the sensors can be transmitted, which give information in respect of which sensor it is at that time. The identification data can also be addresses of the individual sensors, for example. This makes it possible, in a particularly elegant manner, to read which sensor indicates a specific state at that time. In addition, bus systems can possibly also operate particularly quickly and, as a result, the safety can be increased once again, if appropriate.

As has already been mentioned, it is conceivable for the sensors themselves to be designed in such a way that they can be connected to a bus. For this purpose, for example, an electronics unit can be integrated in the sensor, which makes this coupling to the bus possible. However, it is also conceivable for the safety apparatus to comprise a bus system, to which the monitoring unit and the controller are connected. The switching states of the sensors and/or identification data of the sensors can be called up and/or transmitted via this bus. In the present case, when the sensors themselves are connected to the bus via an electronics unit, the controller of the safety apparatus in accordance with the invention can either be integrated itself in turn in the monitoring unit, or else it is furthermore conceivable for a plurality of controllers to be provided which, to a certain extent, form the electronics unit of the respective sensors and, furthermore, enable coupling to the bus.

In one embodiment of the invention, the sensors can be designed as follows, for example: a contact link and a contact receptacle for receiving the contact link can be provided, which are arranged in such a way that the closing state of the elevator door can be determined by connection of contact receptacle and contact link. The detection state of the sensor is therefore dependent on the contact link and the contact receptacle coming close to one another.

An elevator itself generally has firstly a cab which can move between individual stories or floors. The individual floors each have shaft openings, with it being possible for the cab to be moved in the region of the shaft openings in a holding position when the cab is intended to approach the corresponding floor. In this holding position, access to the cab is then enabled. This access can be made possible by virtue of the fact that the elevator doors are opened and then closed again and locked prior to the continued journey. Elevator doors can be shaft doors or cab doors. The shaft doors are mounted fixedly or movably in the region of the shaft opening on the shaft itself. In turn, the cab doors are mounted fixedly and movably on the cab. Generally, in each case one cab door is associated with a shaft door, with both doors being arranged so as to overlap one another (so as to overlap one another at least partially) in the holding position. The doors can usually be moved in synchronism. The corresponding sensor is designed, for example, to check whether the corresponding door of an elevator or a shaft is open or closed and locked. In the present case, it is particularly advantageous to design the sensor in a similar manner to a plug-type connection, with the result that a contact link can engage in a contact shaft. In addition, this measure provides the possibility of an apparatus which is mechanically very stable. In principle, the sensor can be designed in such a way that the contact link can also be accommodated in the shaft of the contact receptacle with play or in a form-fitting manner.

In addition, the contact link is designed such that it comprises at least one transmission element for transmitting an optical signal. As a result, in particular a so-called failsafe circuit can advantageously be achieved. Only when the contact link has reached a specific position owing to corresponding connection to the contact receptacle during closing of the door can a corresponding enable for travel be issued. The transmission element can be designed in such a way that the transmission of the optical signal takes place in a specific way which can be manipulated only with great difficultly (in contrast to the light barrier) and is also not readily implemented by accident.

Another option consists in arranging the transmitter or the receiver on the contact receptacle. The transmission of the light via the transmission element can then take place only via the contact link. This design enables a particularly compact construction.

The transmission element can have, for example, a reflective surface. However, it is also conceivable for the transmission element to be an optical medium, which is used for light transmission, for example a fiberoptic conductor. The transmitter can be in the form of a light-emitting diode, for example, and the receiver can in turn be in the form of a photodiode. These are particularly reliable, long-life and favorable standard electronic components. Moreover, it is also conceivable for the contact receptacle to comprise transmission elements for transmitting the optical signal. The sensor can also comprise an electronics unit for evaluating the receiver, which electronics unit is designed to interpret the evaluation of the receiver to give one of the switching states and/or an electrical signal. This means that the electronics unit is designed to generate an electrical signal or produce an electrical contact. Since, however, the mechanical closing state is detected purely optically, this means in this case that a mechanical contact or a mechanical opening state does not necessarily need to be produced again in order to obtain an electrical signal. For example, it is conceivable for the optical signal to switch through the receiver, for example a photodiode, and therefore no interruption of a circuit in the sense of an open switch is required.

Furthermore, it is conceivable for the sensors to be in the form of inductive or capacitive sensors. An inductively operating sensor measures a voltage pulse which is produced in a coil or an inductance as a result of induction. This voltage is induced when the coil/inductance approaches a magnetic field, for example. The change over time in the magnetic field results in a voltage pulse which is dependent on how quickly the change in the magnetic field occurs, how severe this change is, etc. Furthermore, a capacitive sensor operates by determination of a capacitance of a probe capacitor. For example, the capacitance of the capacitor is changed by changing the distance between the capacitor plates or by introducing another material between the capacitor plates. The change in the capacitance can be measured and can be interpreted, for example in respect of a closing state. It is also conceivable for such an arrangement to be selected in the case of an inductive and capacitive sensor as well because one contact receptacle and a contact link are provided. An inductive and capacitive sensor can also have the advantages of an optical sensor, which does not necessarily interrupt a circuit, in contrast to an electromechanical switch.

Embodiments are conceivable in accordance with which, despite the fact that a safety device is provided which has sensors, in addition a safety circuit is provided. This may be a conventional safety circuit. In particular when a corresponding safety apparatus is retrofitted, it is conceivable for in addition such a safety circuit to be retained. In particular, this safety circuit can also have electromechanical switches. The safety circuit can therefore have the mode of operation in accordance with which it has a closed and an open conduction state and a dedicated interruption apparatus for interrupting the drive depending on the conduction state of the safety circuit.

However, it is also conceivable for the safety circuit to be connected to the interruption apparatus of the monitoring unit, which interruption apparatus is integrated in the monitoring unit, for example. This coupling to the interruption apparatus of the monitoring unit makes it possible for the safety circuit to be linked directly to the monitoring unit or to the lift control system. As a result, the safety circuit can be checked at least partially directly using the monitoring unit, but in principle a simpler and more detailed check is possible directly using the monitoring unit when using sensors. A measure in which a safety circuit is retained, or is connected to a monitoring unit, is conceivable in particular in the case of retrofitting for such a safety apparatus according to the invention.

For direct checking, in addition an indicator apparatus for indicating the switching state of the individual sensors with assignment of the individual switching states to the corresponding sensors can be provided. Precisely in the case where there is a fault, or a sensor indicates an interruption, it is possible to check directly and possibly centrally, for example also using the monitoring unit, which sensor is affected. In addition, other data can also be indicated which are typical of the sensor and which give information, for example, in respect of whether the sensor is defective or whether an unenvisaged state, for example, is actually present, for example an elevator door is blocked.

In addition, in the case of a sensor, the communication with the controller can take place via modulation of the internal resistance of the sensor. In the circuit, the voltage or the current intensity can be modulated. This modulation then carries the information which is intended to be transmitted in the communication. For example, a circuit which comprises series-connected sensors and a controller (likewise connected in series) is conceivable. If the resistance of a sensor in the case of series-connected sensors varies, the current intensity changes. If, for example, a constant current source is used for the circuit, a change in the resistance means that the voltage needs to be increased in order to compensate for the resulting decrease in the current intensity which is caused by the lower resistance initially. Therefore, the modulation can act as information carrier. The change in the current intensity or voltage can be measured and can be interpreted correspondingly as information. In one development of the invention, the controller can in turn be designed to implement the communication with sensors by modulation of the current intensity or the voltage. This measure can take place by changes in resistances or corresponding changes in or matching of voltage or current intensity.

In the case of the series circuit, it is particularly advantageous if the sensor has a low contact resistance. The resistance of a sensor can be, for example, in the range of from 1Ω (ohm) to 100Ω, in particular in the range of from 5Ω to 20Ω, preferably less than 10Ω. Precisely in the case of a series circuit, it is advantageous to design the contact resistance to be as small as possible, in particular less than 10Ω, in order that the voltage drop across the sensor is not excessively high.

Correspondingly, a drive apparatus for elevator apparatuses which can move a cab via a drive with a drive motor for moving the cab is characterized by the fact that a safety apparatus according to the invention or an embodiment of the invention is provided.

In addition, correspondingly, an elevator apparatus which can move a cab via a drive with a cab and at least one elevator door for opening and/or closing the cab and with a safety apparatus, wherein the drive comprises a drive apparatus, is characterized by the fact that the drive apparatus or the safety apparatus is designed in accordance with the invention or in accordance with one embodiment of the invention.

BRIEF DESCRIPTION OF THE DRAWINGS

Exemplary embodiments of the invention will be illustrated in more detail in the drawings and will be explained in more detail below indicating further details and advantages.

DETAILED DESCRIPTION OF THE INVENTION

Figure 1:
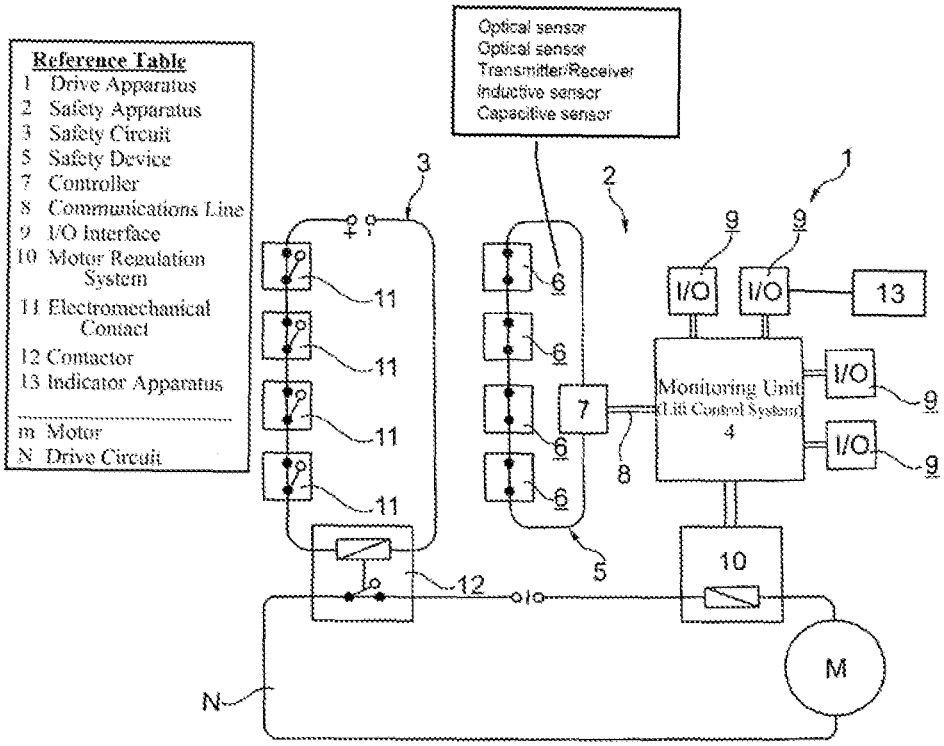
FIG. 1 shows a drive apparatus in accordance with the invention.
Figure 5:
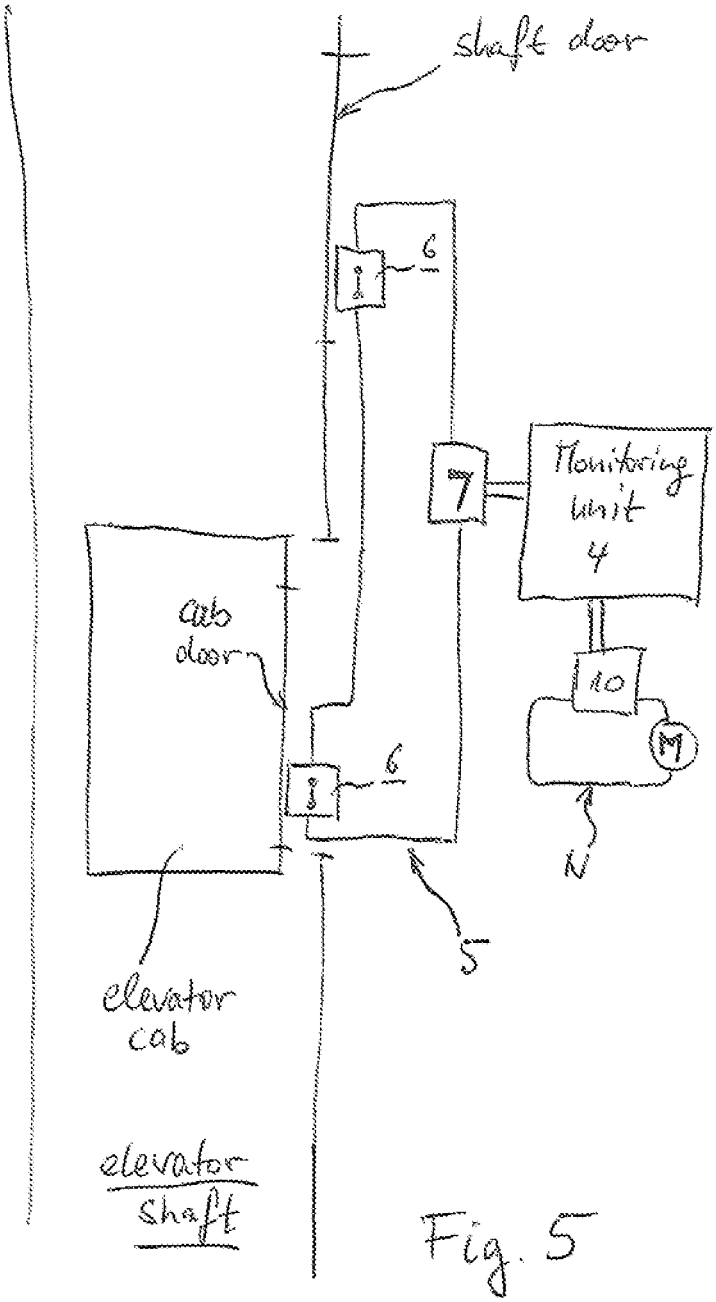
FIG. 5 illustrates an example of an elevator cab in the elevator shaft in relation to the sensors, controller and monitoring unit in one embodiment of the safety apparatus of the present invention.

FIG. 1 shows a drive apparatus 1 with a drive circuit N, into which a motor M for driving a cab is connected. In addition, the drive apparatus comprises a safety circuit 3 and a safety apparatus 2. This safety apparatus 2 firstly comprises a monitoring unit 4, such as a lift control system, as well as a safety device 5. The safety device 5 in turn comprises sensors 6, namely optical sensors. These optical sensors determine the locking state of the elevator door. In addition, the sensors 6 are connected in series. The safety device 5 also comprises a controller 7. This controller is connected to the monitoring unit 4, via a communications line 8. Furthermore, the monitoring unit 4 has further input/output interfaces (I/O interfaces 9), and furthermore a connection to the motor regulation system 10. For example, FIG. 5 illustrates a sensor 6 at two adjacent floors in a building connected to controller 7. The elevator cab is shown in the elevator shaft in relation to sensors 6 at each floor with the elevator cab stopped at one floor. Each of the sensors 6 is shown connected to the controller 7, which is connected to the monitoring unit 4 and the motor regulation system, as shown in FIG. 5. In addition, the safety circuit 3 comprises electromechanical switches 11. These electromechanical switches are also connected in series and are connected to a contactor 12, which can in turn interrupt the drive circuit N.

In the case of retrofitting, the safety apparatus 2 could be completely retrofitted. If the safety circuit 3 is intended to be retained, this can take place as is illustrated. In the case in which one of the sensors 6 indicates a blocked state, for example, the controller 7 signals this directly to the monitoring unit 4, which in turn directly stops the motor regulation system 10, with the result that the motor regulation system stops the motor M. Coupling to an indicator apparatus 13 is possible via the I/O interface 9, with the result that the corresponding state can also be indicated to the operator or the monitoring personnel.

Figure 2:
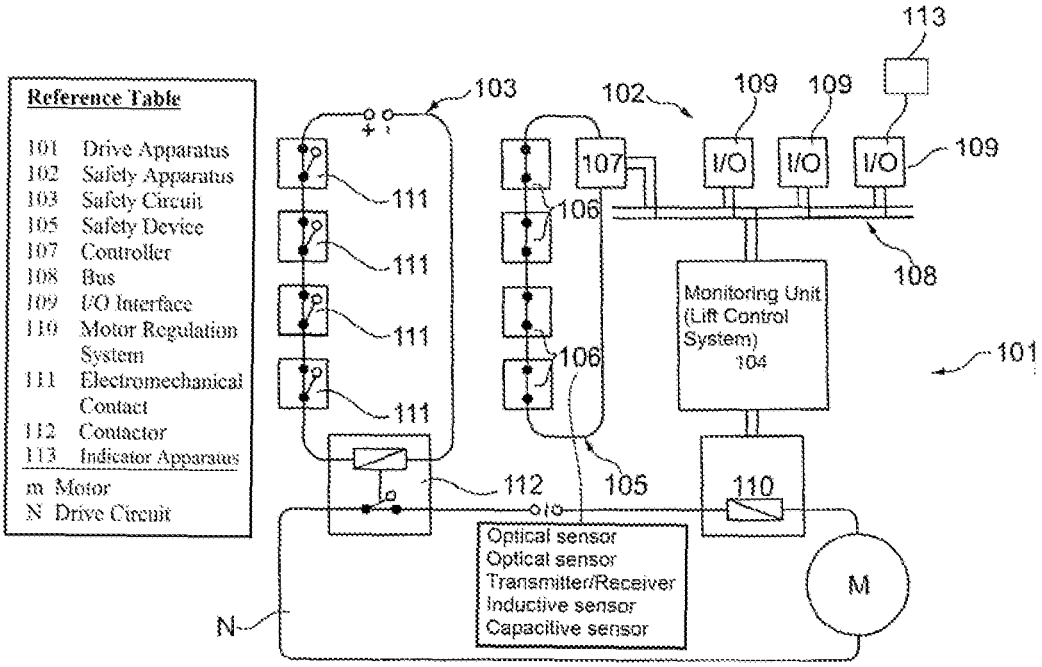
FIG. 2 shows a drive apparatus with a bus system in accordance with the invention.

FIG. 2 shows a similar drive apparatus 101 with a drive circuit N, which comprises a motor M. In addition, a safety circuit 103 is still provided, in which electromechanical switches 111 are connected in series. The electromechanical switches drive a contactor 112, which is designed to interrupt the drive circuit N. In addition, a safety apparatus 102 is provided, which in turn has a safety device 105. This safety device 105 in turn has a plurality of optical sensors 106, which are connected in series, and a controller 107, which is likewise connected in series. The controller 107 is also in this case connected to the monitoring unit 104, such as the lift control system. The monitoring unit 104 in turn has a connection to the motor regulation system 110, which is connected into the drive circuit N.

In contrast to the apparatus shown in FIG. 1, in this case a bus system 108 is provided in FIG. 2, however. The monitoring unit 104 is connected to this bus system. The monitoring unit 104 can act as master, for example. The controller 107, whose electronics unit is designed for connection to a bus system correspondingly, is likewise connected to the bus system 108. Furthermore, a plurality of I/O interfaces 109, which can be provided for outputting data to an indicator apparatus 113, for example, are connected to the bus system 108. Otherwise, the mode of operation of the safety apparatus 102 in FIG. 2 corresponds to the mode of operation of the safety apparatus 2 in FIG. 1.

Figure 3:
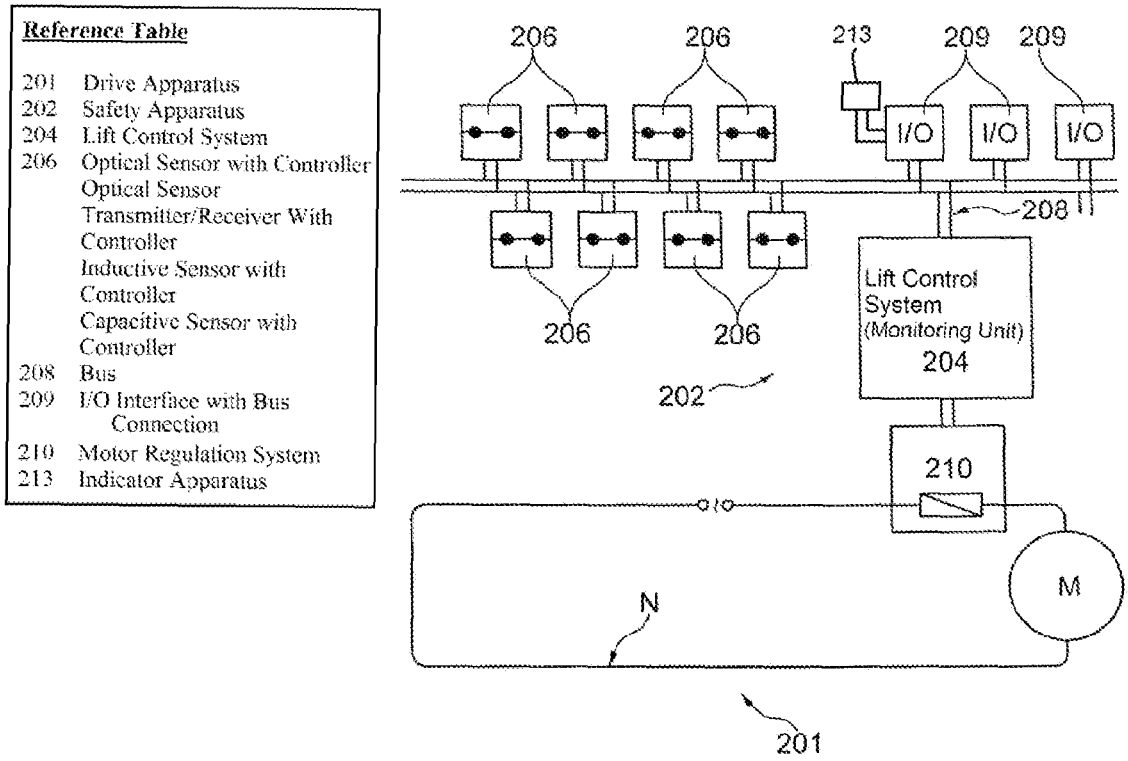
FIG. 3 shows a drive apparatus with a bus system in accordance with the invention, in which the sensors are coupled directly to the bus.

In turn, FIG. 3 shows a drive apparatus 201 with a drive circuit N and a motor M for the cab. A safety circuit is no longer provided in this apparatus. Furthermore, in the drive apparatus shown in FIG. 2, there are also no electromechanical contacts or electromechanical switches. The lift control system 204, which in turn is coupled to the motor regulation system 210, which can also directly disconnect the drive of the motor, is central in the apparatus shown in FIG. 3. In this embodiment, the lift control system 204 acts as the monitoring unit.

The lift control system 204 in turn is likewise connected to a bus system 208. The lift control system 204 acts as master of the bus system, and the other connected components act as slave. Correspondingly, a series of sensors, in particular optical sensors 206, are provided, which are connected to the bus system. Correspondingly, the safety apparatus shown in FIG. 3, comprises the safety apparatus 202, the lift control system 204, the bus system 208 and the sensors 206. In the present case, the controller is designed in such a way that individual controllers are integrated in the respective sensors 206, with the individual controllers in turn being capable of being coupled to the bus system. Furthermore, it is conceivable for the sensors 206 to be designed in such a way that only one electronics unit for coupling to the bus 208 is provided, while the controller is integrated centrally in the lift control system 204 and is likewise addressed via the bus. Furthermore, input/output interfaces 209 are connected to the bus 208. An indicator apparatus can be connected to one of the input/output interfaces 209 to provide data to an operator or the monitoring personnel. Moreover, the mode of operation of the apparatus shown in FIG. 3 corresponds to that shown in FIGS. 1 and 2, with in this case the disconnection taking place directly via the motor regulation system 210.

Figure 4:
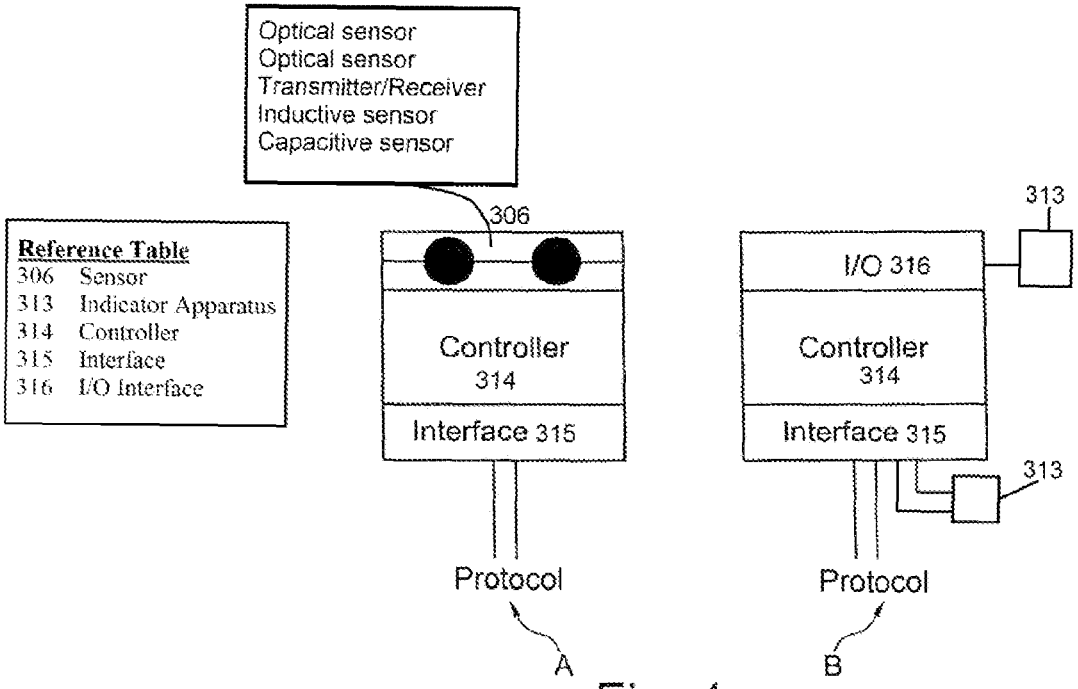
FIG. 4 shows a schematic illustration of two controller types.

FIG. 4 shows, by way of example, the way in which corresponding controllers can be connected. The illustration A shows a controller 314 which is connected directly to the sensor 306 and is furthermore connected to an interface 315, which is part of the transmission or communication device (not shown) with which a communications link can be made to the lift control system 204 or the monitoring unit 104 via a communications line or which is connected directly to the bus system via the interface 315. A controller 314 in accordance with illustration B is linked directly to an input/output interface 316, which can be connected to another appliance, for example an indicator apparatus 313, and in addition to an interface 315, which can likewise pass on data via a protocol, i.e. for example directly via a data line to the lift control system 204 or monitoring unit 104 and possibly also to a bus system for transmission.

LIST OF REFERENCE SYMBOLS

1 Drive apparatus
2 Safety apparatus
3 safety circuit
4 Lift control system/monitoring unit
5 Safety device
6 Sensor
7 Controller
8 Communications line
9 Input/output interface
10 Motor regulation system
11 Electromechanical contact
13 Indicator apparatus
12 Contactor
101 Drive apparatus
102 Safety apparatus
103 safety circuit
104 Lift control system/monitoring unit
105 Safety device
106 Sensor
107 Controller
108 Bus
109 Input/output interface
110 Motor regulation system
111 Electromechanical contact
112 Contactor
113 Indicator apparatus
201 Drive apparatus
202 Safety apparatus
204 Lift control system
206 Sensor with bus connection
208 Bus
209 I/O interface with bus connection

210 Motor regulation system
213 Indicator apparatus
306 Sensor
313 Indicator apparatus
314 Controller
315 Interface
316 I/O interface
M Drive motor
N Drive circuit

We claim:

1. A safety apparatus for an elevator apparatus which can move a cab via a drive, comprising:

a monitoring unit for monitoring at least one of the drive and the motor regulation system of the drive, a safety device having at least two sensors that are switched between at least two switching states depending on a state of the elevator apparatus, wherein at least one of the safety device and the monitoring unit comprises a controller that identifies the respective switching states of the sensors, and transmits at least one of data and monitoring signals to the monitoring unit, and the monitoring unit further comprises an interruption apparatus for interrupting the drive depending on at least one of the data and monitoring signals from the controller, wherein the sensors and the controller are connected in series.

2. The safety apparatus according to claim 1, wherein the controller receives at least one of data and monitoring signals from the monitoring unit.

3. The safety apparatus according to claim 1, wherein the safety device is in the form of a bus system, wherein the sensors each have an electronics unit which is connected to the bus, such that at least one of the switching states of the sensors and identification data from the sensors is communicated via the bus.

4. The safety apparatus according to claim 1, further comprising a bus system to which the monitoring unit and the controller are connected, such that at least one of the switching states of the sensors and identification data of the sensors is communicated via the bus.

5. The safety apparatus according to claim 1, further comprising a safety circuit having a closed and an open conduction state and which comprises a dedicated interruption apparatus for interrupting the drive depending on the conduction state of the safety circuit.

6. The safety apparatus according to claim 1, further comprising a safety circuit having a closed and an open conduction state, the safety circuit being connected to the interruption apparatus of the monitoring unit.

7. The safety apparatus according to claim 5, wherein the safety circuit comprises at least one electromechanical switch.

8. The safety apparatus according to claim 1, further comprising an indicator apparatus for indicating the switching state of the individual sensors with assignment of the individual switching states to the corresponding sensors.

9. A drive apparatus for an elevator, comprising a drive motor, and a safety apparatus according to claim 1.

10. An elevator apparatus which can move a cab via a drive, comprising a cab, at least one elevator door for opening and closing the cab, and a safety apparatus according to claim 1.

11. The elevator apparatus according to claim 1, wherein the sensors are switched between the two switching states depending upon a closing state of an elevator door of the elevator apparatus.

* * * * *